US005813155A

United States Patent [19]

Shen

[11] Patent Number: 5,813,155

[45] Date of Patent: Sep. 29, 1998

[54] PICTURE FRAME AND LAMP ARRANGEMENT

[76] Inventor: Wei-Hong Shen, 6F, No. 416, Sec. 4, Jen-Ai Rd., Taipei, Taiwan

[21] Appl. No.: 834,307

[22] Filed: Apr. 15, 1997

[51] Int. Cl.[6] ..... A47G 1/06

[52] U.S. Cl. ..... 40/715; 40/746; 40/749; 40/757; 248/126; 248/455

[58] Field of Search ..... 40/715, 562, 559; 248/126, 455

[56] References Cited

U.S. PATENT DOCUMENTS

| | | | |
|---|---|---|---|
| 752,943 | 2/1904 | Allen | 40/746 |
| 1,409,114 | 3/1922 | Loeberg | 40/715 |
| 1,423,433 | 7/1922 | Ketchem | 40/715 |
| 4,504,892 | 3/1985 | Zulfilar | 40/559 |
| 5,016,852 | 5/1991 | Herendeen | 248/455 |

*Primary Examiner*—Cassandra H. Davis
*Attorney, Agent, or Firm*—Rosenberg, Klein & Bilker

[57] ABSTRACT

A combined display frame and lamp system is provided. This system includes a display frame; a mount fastened to the display frame; and, a lamp holder secured relative to the display frame through a connecting mechanism coupled to the mount. The system also includes a back support pivotally coupled to the mount for supporting the mount and the display frame on a support surface.

7 Claims, 8 Drawing Sheets

PICTURE FRAME AND LAMP ARRANGEMENT

BACKGROUND OF THE INVENTION

The present invention relates to a picture frame and lamp arrangement which combines a picture frame and a lamp holder into a unit convenient for mounting on a table top or hanging on a wall support.

Regular lamps may be designed for use on the desk, the wall, or the ceiling, and decorated with a variety of ornamental designs. Further, people may decorate the wall of their house with pictures. When a wall lamp or a picture is installed in the wall, it cannot be conveniently changed to another place.

SUMMARY OF THE INVENTION

The present invention provides a picture frame and lamp arrangement which combines a picture frame and a lamp holder into a unit convenient for supporting on a desk or mounting on a wall support. According to the present invention, the picture frame and lamp arrangement comprises a picture frame, a mount fastened to the picture frame, a back support pivoted to the mount and adapted for supporting the mount and the picture frame on a surface, a lamp holder, and connecting means connected between the lamp holder and the mount. According to one embodiment of the present invention, the connecting means comprises a tubular connecting rod having one end connected to the lamp holder and an opposite end connected to the mount, and an electric wire inserted through the tubular connecting rod and adapted for connecting electric power to the lamp holder. According to another embodiment of the present invention, the connecting means comprises two parallel connecting rods having a respective rear end coupled to the mount and a respective front end, two mounting rods bilaterally and fixedly fastened to the lamp holder, and two connectors respectively coupled between the mounting rods and the front ends of the connecting rods, permitting the mounting rods to be turned relative to the connecting rods, wherein the connecting rods, the mounting rods and the connectors are made from electrically conductive material.

DETAILED DESCRIPTION OF THE PREFERRED EMBODIMENT

Figure 1:
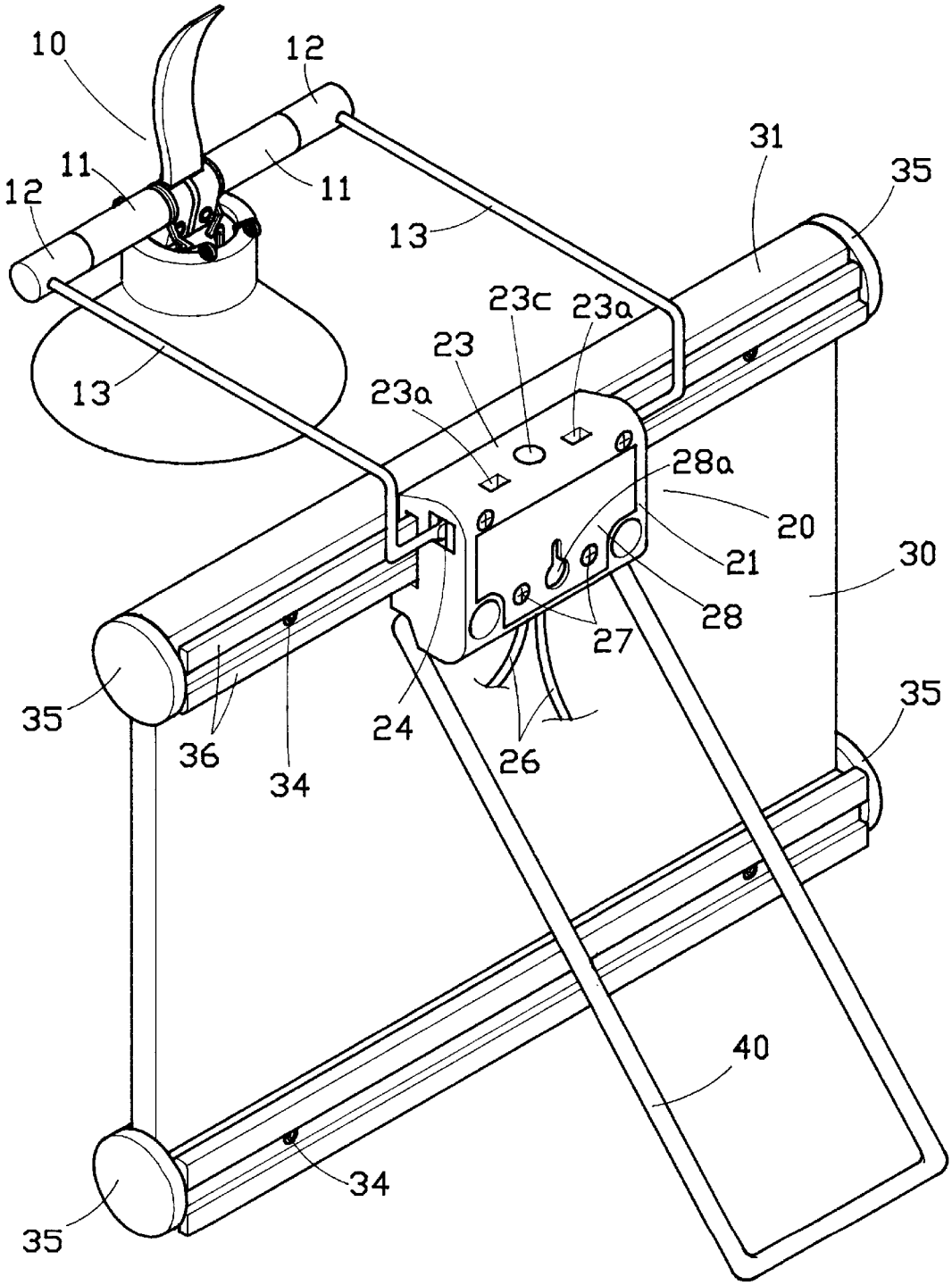
FIG. 1 is an elevational view of a picture frame and lamp arrangement according to a first embodiment of the present inventions.
Figure 2:
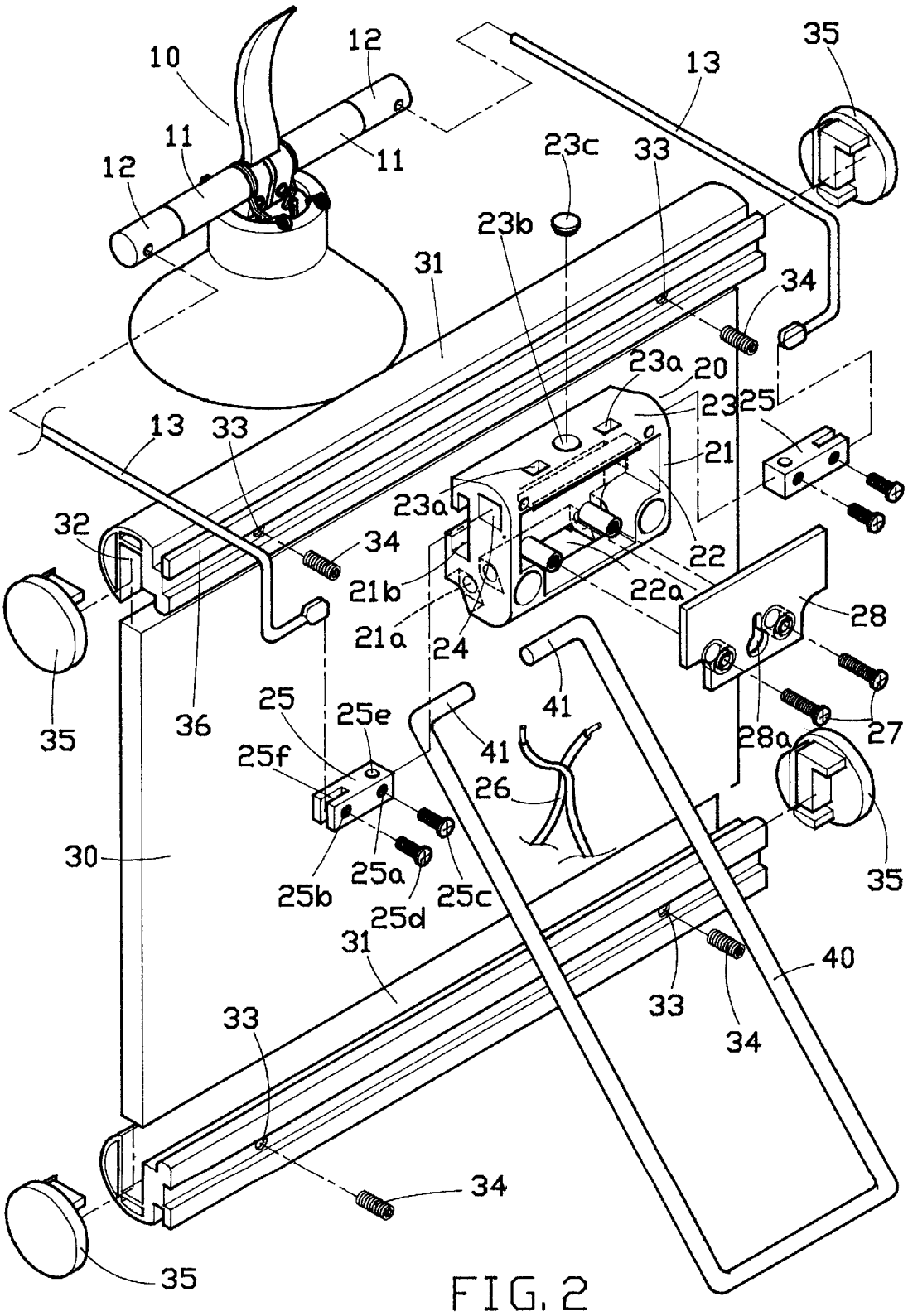
FIG. 2 is an exploded view of the picture frame and lamp arrangement of the first embodiment shown of the present invention.
Figure 3:
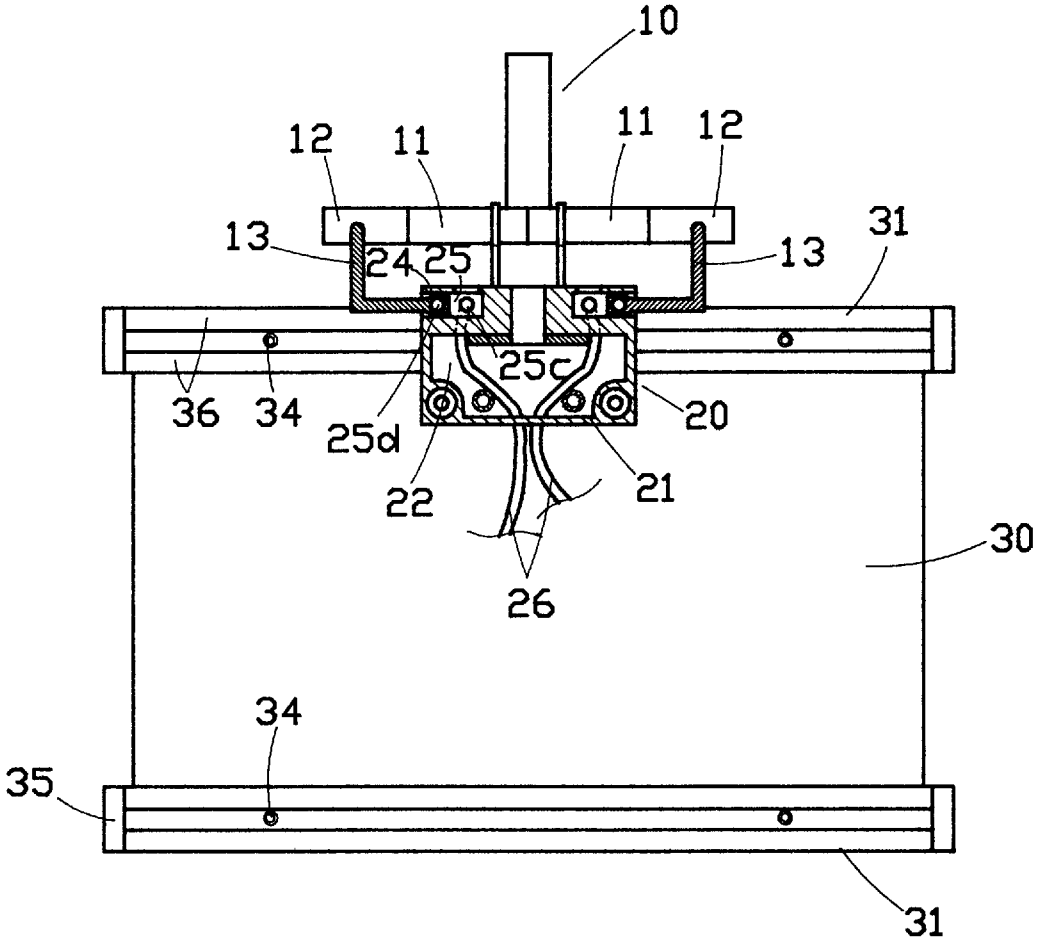
FIG. 3 is a sectional plain view of the picture frame and lamp arrangement of the first embodiment of the present invention.

Referring to FIGS. 1, 2 and 3, a picture frame and lamp arrangement in accordance with the present invention is generally comprised of a lamp holder 10, a sliding mount 20, a picture frame 30, and a back support 40.

The lamp holder 10 comprises two mounting rods 11 aligned at two opposite sides, and two parallel connecting rods 13 respectively and perpendicularly connected to the mounting rods 11 by a respective connector 12. The connecting rods 13 have a respective opposite end respectively connected to the sliding mount 20. The mounting rods 11, the connectors 12 and the connecting rods 13 are respectively made from electrically conductive material through which 12 V low voltage power supply can be transmitted to the lamp holder 10. The mounting rods 11 are respectively pivoted to the connectors 12, therefore the lamp holder 10 can be turned about an axis between the connectors 12.

The mount 20 comprises a casing 21, two metal blocks 25, and a back cover 28. The casing 21 comprises a back chamber 22, two opposite side through holes 24 at two opposite lateral sides in communication with the back chamber 22, a top center plug hole 23*b* at the center of its top side 23, a cap 23*c* covered on the top center plug hole 23*b*, two top side plug holes 23*a* disposed at its top side 23 and equally spaced from the top center plug hole 23*b* in reversed directions, a bottom wire hole 22*a*, two opposite side coupling holes 21*a* bilaterally disposed near its bottom side, and a front coupling groove 21*b* horizontally disposed at its front side and adapted for coupling to the picture frame 30. The back cover 28 is covered on the back chamber 22 of the casing 21 and fixedly secured thereto by screws 27, having a hanging hole 28*a* for hanging. The metal blocks 25 are respectively mounted in the side through holes 24 of the casing 21. Each metal block 25 comprises a first screw hole 25*a* and a second screw hole 25*b*, a first tightening up screw 25*c* and a second tightening up screw 25*d* respectively threaded into the first screw hole 25*a* and the second screw hole 25*b*, a plug hole 25*e* communicating with the first screw hole 25*a* and aligned with one top side plug hole 23*a* of the casing 21, and a mounting slot 25*f* communicating with the second screw hole 25*b* and adapted to receive one connecting rod 13. The connecting rods 13 have a respective flat rear end respectively inserted through the side through holes 24 of the casing 21 into the mounting slots 25*f* of the metal blocks 25 and then respectively fixed in place by the second tightening up screws 25*d*. Two conductors 26 are respectively inserted through the bottom wire hole 22*a* of the casing 21 into the back chamber 22, and then respectively fastened to the plug holes 25*e* of the metal blocks 25 by the first tightening up screws 25*c*. Through the conductors 26, a low voltage power is transmitted from a power source (not shown) to the metal blocks 25, and then transmitted from the metal blocks 25 through the connecting rods 13 and the mounting rods 11 to the lamp holder 10.

The picture frame 30 has its top and bottom sides respectively covered with a respective rail 31 for protection. Each rail 31 comprises a coupling groove 32 coupled to the top or bottom side of the picture frame 30, a plurality of screw holes 33 perpendicularly extended to the coupling groove 32, and a plurality of tightening up screws 34 respectively threaded into the screw holes 33 to hold down the picture frame 30 in the coupling groove 32. Further, two end caps 35 are respectively fastened to two opposite ends of each rail 31. The rail 31 which is disposed at the top side has a track 36 to which the front coupling groove 21*b* of the mount 20 is coupled.

The back support 40 is made from a metal wire, having two ends 41 respectively inserted into the side coupling holes 21*a* of the casing 21 for supporting the mount 20 and the picture frame 30 on for example a table top. When the back support 40 is coupled to the mount 20, is can be turned in the side coupling holes 21*a* of the casing 21 to adjust the tilting angle of the picture frame 30. When the back support 40 is turned inwards and closely attached to the picture frame 30, the whole assembly can be hung on the wall by the hanging hole 28*a* of the back cover 28.

Figure 4:
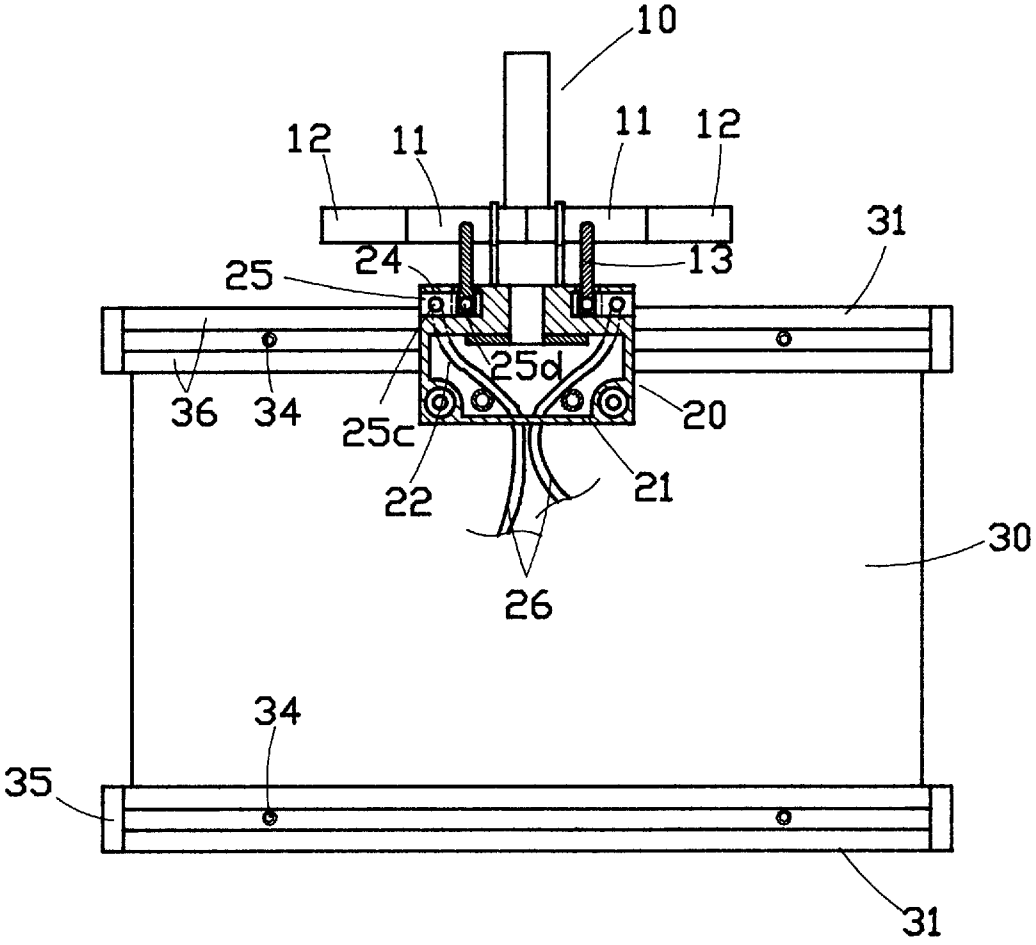
FIG. 4 is a sectional plain view of a picture frame and lamp arrangement according to a second embodiment of the present invention.

FIG. 4 shows a second embodiment of the present invention. According to this alternate form, the metal blocks 25 are reversely mounted in the side through holes 24 of the casing 21 of the mount 20, the connecting rods 13 are respectively inserted into the top side plug holes 23*a* of the casing 21 and then fastened to the mounting slots 25*f* of the metal blocks 25 by the respective second tightening up screws 25*d*.

Figure 5:
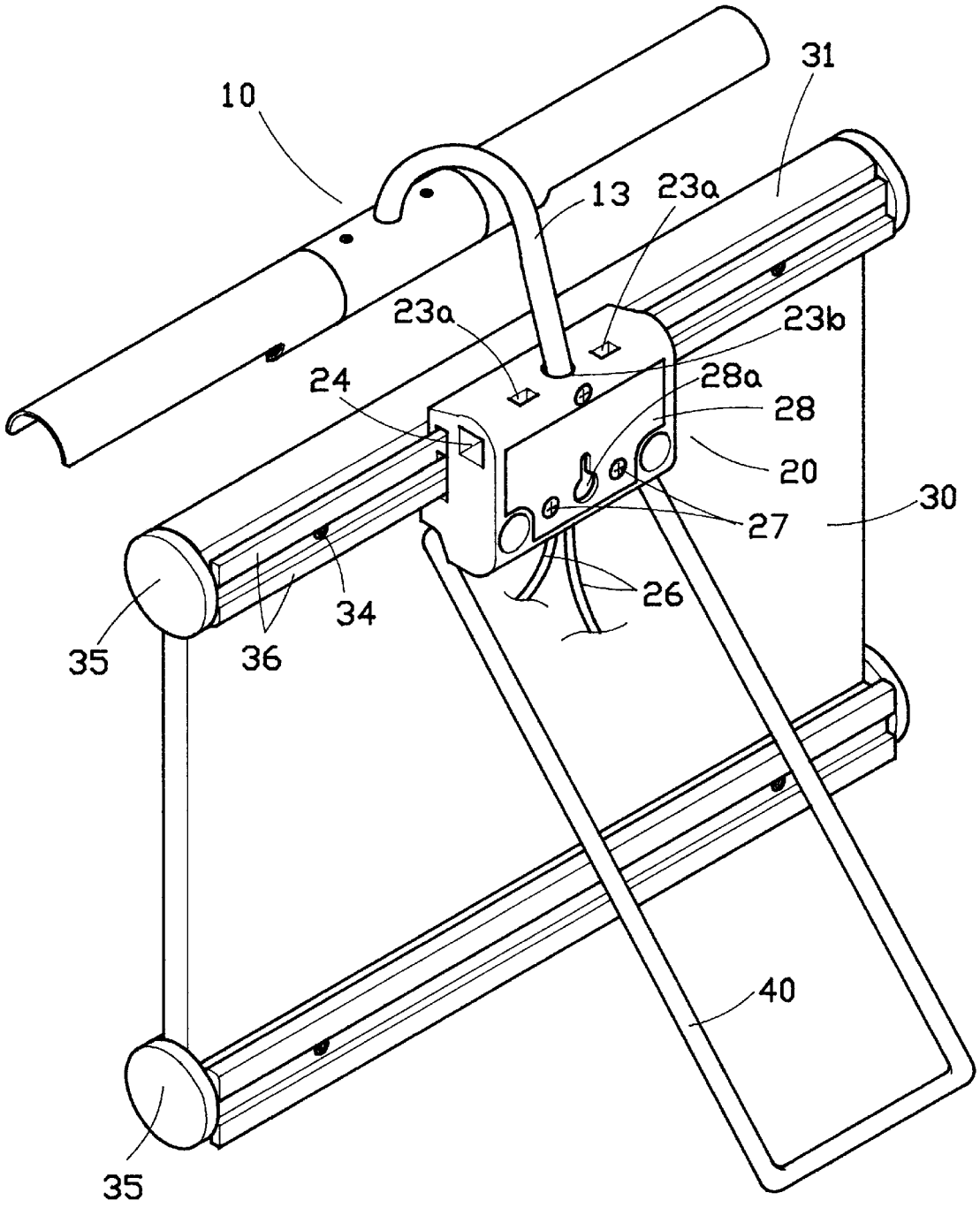
FIG. 5 is elevational view of a picture frame and lamp arrangement according to a third embodiment of the present invention.
Figure 6:
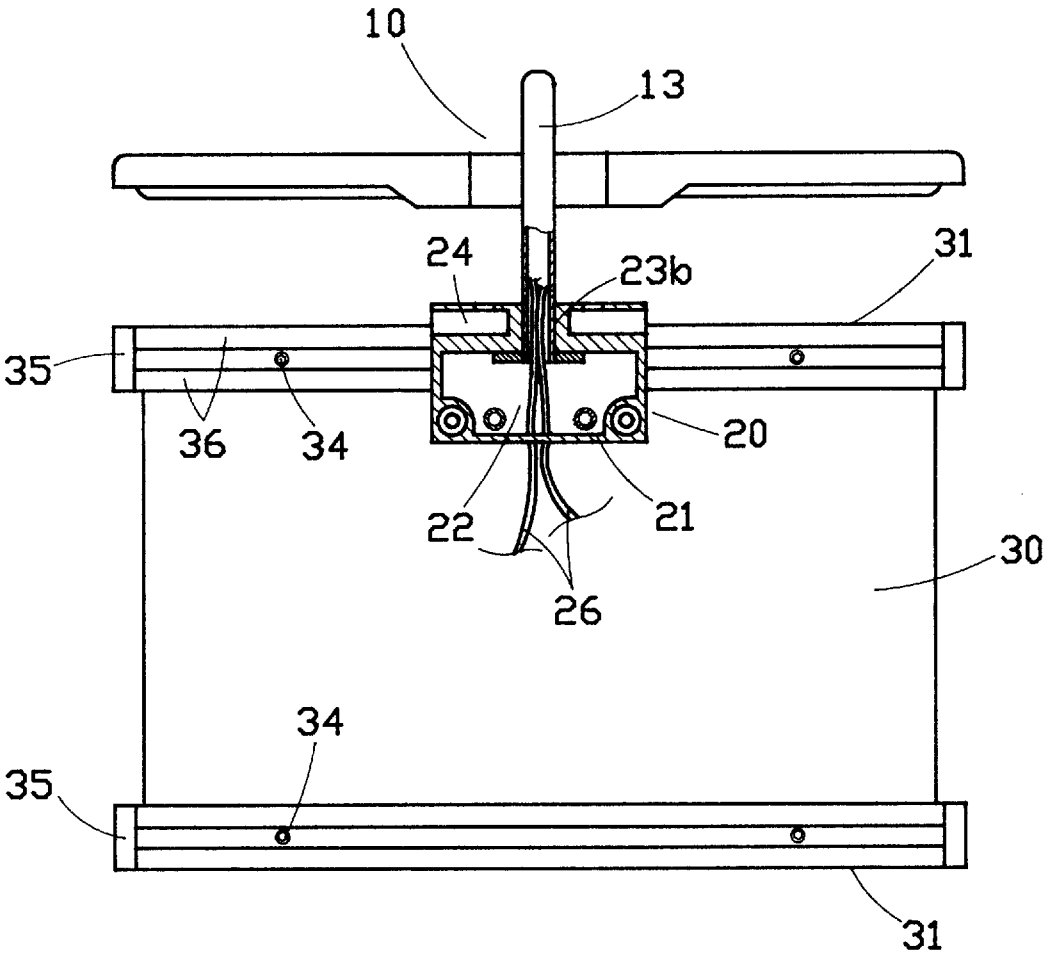
FIG. 6 is a sectional plain view of the picture frame and lamp arrangement of the third embodiment of the present invention.

FIGS. 5 and 6 show a third embodiment of the present invention. According to this embodiment, the lamp holder 10 is provided with only one connecting rod 13, and the aforesaid metal blocks 25 are eliminated. The connecting rod 13 is an electrically insulative tube having its end fastened to the top center plug hole 23*b* of the mount 20. The conductors 26 are directly inserted through the connecting rod 13 and connected to the lamp holder 10, and adapted to transmit for example 110 V AC to the lamp holder 10. The lamp holder 10 can be of any type of lamp holder for holding a bulb or lamp tube, or a plurality of bulbs or lamp tubes.

Figure 7:
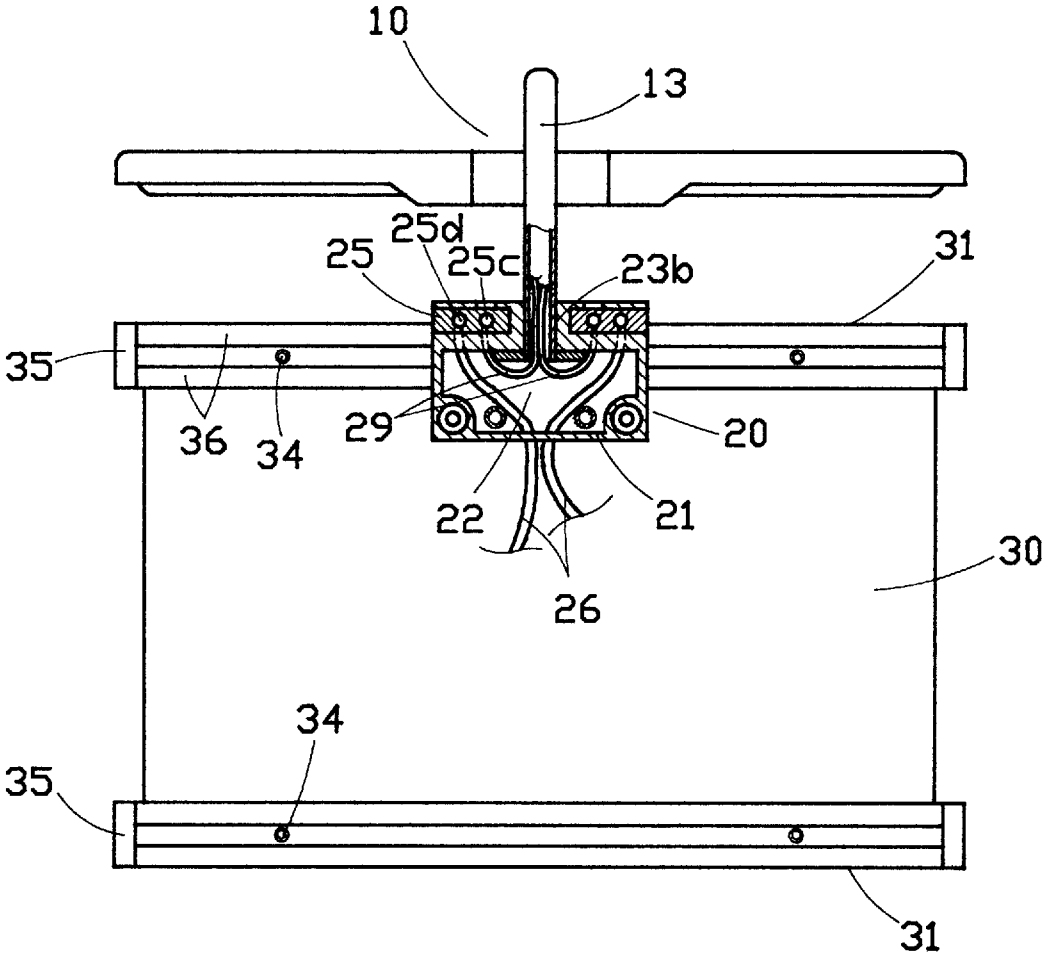
FIG. 7 is a sectional plain view of a picture frame and lamp arrangement according to a fourth embodiment of the present invention.

FIG. 7 shows a fourth embodiment of the present invention. This embodiment is similar to the aforesaid third embodiment. However, the aforesaid metal blocks 25 are still maintained mounted inside the mount 20. The conductors 26 are respectively fastened to the metal blocks 25. Two electric wires are respectively mounted inside the mount 20 and connected between the metal blocks 25 and the lamp holder 10.

Figure 8:
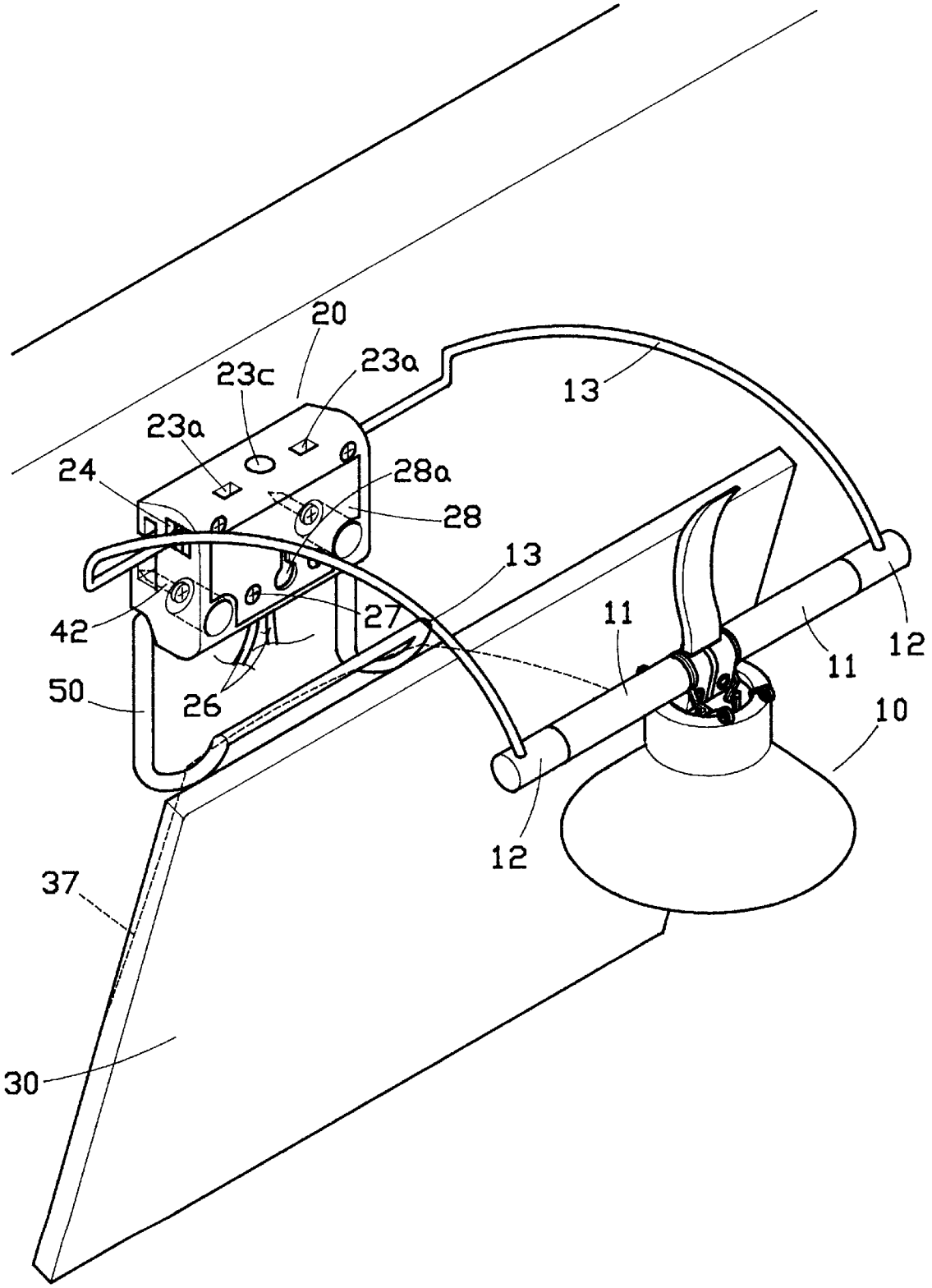
FIG. 8 is an elevational view of a picture frame and lamp arrangement according to a fifth embodiment of the present invention.

FIG. 8 shows a fifth embodiment of the present invention. This embodiment is a wall mount design. According to this embodiment, the aforesaid back support 40 is eliminated, the mount 20 is directly fastened to the wall by screws 42, having a hanger 50 on which the picture frame 30 is hung by a hanging wire 37.

It is to be understood that the drawings are designed for purposes of illustration only, and are not intended as a definition of the limits and scope of the invention disclosed, and various modifications and changes could be made thereunto without departing from the spirit and scope of the invention disclosed. For example, the back support 40 can be directly fastened to the picture frame 30; the lamp holder can be a double-head lamp holder for holding two sets of lamps.

What the invention claimed is:

1. A combined display frame and lamp system comprising:

(a) a display frame assembly;

(b) a mount assembly displaceably coupled to said display frame assembly for substantially independent displacement relative thereto;

(c) a support member pivotally coupled to said mount assembly for supporting said mount and said display frame assemblies; and, (d) a lamp holder assembly adjustably coupled to said mount assembly.

2. The combined display frame and lamp system as recited in claim 1 further comprising connecting means coupled to said lamp holder and said mount assembly adapted to adjustably support said lamp holder in spaced relation to said frame assembly.

3. The combined display frame and lamp system as recited in claim 2 wherein said connecting means is electrically conductive, said connecting means being adapted to electrically couple said lamp holder to a power source.

4. The combined display frame and lamp system as recited in claim 2 wherein said mount assembly includes:

(a) a casing member having formed therein a back chamber, a pair of laterally opposed side through holes in open communication with said back chamber, and a bottom wire hole;

(b) a back cover member coupled to said casing member to substantially cover said back chamber thereof;

(c) a pair of block members respectively received in said side through holes of said casing member, each of said block members having formed therein a mounting slot for engaging said connecting means, a plug hole adapted to receive an electric conductor therein, and a pair of screw holes in open communication, respectively, with said mounting slot and said plug hole; and, (d) screw tightening means adjustably mated to each said screw hole, said screw tightening means being adapted to secure said connecting means within said mounting slot and to secure said electric conductor within said plug hole.

5. The combined display frame and lamp system as recited in claim 4 wherein said back cover member of said mount assembly has formed therein a hanging hole adapted to engage a support structure.

6. The display frame and lamp system of claim 1 wherein said mount assembly comprises a hanging hole for hanging.

7. A display frame and lamp arrangement comprising:

a display frame;

a mount fastened to said display frame;

a back support pivoted to said mount and adapted for supporting said mount and said display frame on a surface;

a lamp holder; and, connecting means connected between said lamp holder and said mount, said connecting means including:

a pair of parallel connecting rods each having a rear end coupled to said mount and a front end;

a pair of mounting rods bilaterally and fixedly fastened to said lamp holder; and, a pair of connectors respectively coupled between said mounting rods and said front ends of said connecting rods adapted to permit said mounting rods to be turned relative to said connecting rods;

said connecting rods, said mounting rods, and said connectors being formed of electrically conductive material.

* * * * *